United States Patent [19]

Roux et al.

[11] Patent Number: 4,752,235

[45] Date of Patent: Jun. 21, 1988

[54] ELECTRICAL CONNECTOR WITH DEFORMABLE RETENTION ELEMENT AND PROCEDURE FOR ASSEMBLY OF SUCH A CONNECTOR

[75] Inventors: Marcel Roux, Saint Hilaire; Michel L. Guerrero, Bois d'Arby; Michel L. Voisard, La Queue les Yvelines, all of France

[73] Assignee: Amphenol Corporation, Wallingford, Conn.

[21] Appl. No.: 867,165

[22] Filed: May 27, 1986

[30] Foreign Application Priority Data

Jun. 4, 1985 [FR] France ..... 85 08395

[51] Int. Cl.[4] ..... H01R 13/00

[52] U.S. Cl. ..... 439/283

[58] Field of Search ..... 439/870, 869, 904, 283, 439/271, 586, 587, 589, 598, 603, 345, 347, 349, 126

[56] References Cited

U.S. PATENT DOCUMENTS

| | | | |
|---|---|---|---|
| 2,059,257 | 10/1934 | Leherman | 439/869 |
| 2,226,414 | 9/1939 | Kapp | 439/869 |
| 2,318,922 | 5/1943 | Carington | 439/869 |
| 2,662,219 | 12/1953 | Hennessey, Jr. et al. | 339/103 |
| 2,783,295 | 2/1957 | Ewing | 439/271 |
| 4,019,799 | 4/1977 | Bouvier | 339/59 R |
| 4,099,323 | 7/1978 | Bouvier | 29/629 |

FOREIGN PATENT DOCUMENTS 922055 5/1950 Fed. Rep. of Germany .

*Primary Examiner*—Joseph H. McGlynn
*Attorney, Agent, or Firm*—Bacon & Thomas

[57] ABSTRACT

An electrical connector in which securing of an insulating body to a protective housing is done by the deformation of an inserted piece. The electrical connector has a special configuration of the insulating body and housing due to the presence of bevels, which makes it possible, by deformation of a retention element, to obtain a rapid and effective assembly.

15 Claims, 3 Drawing Sheets

PRIOR ART
FIG_1
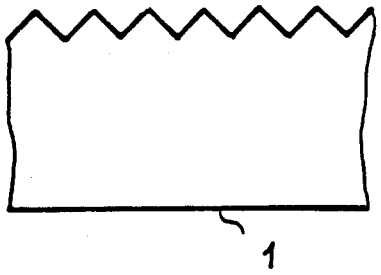
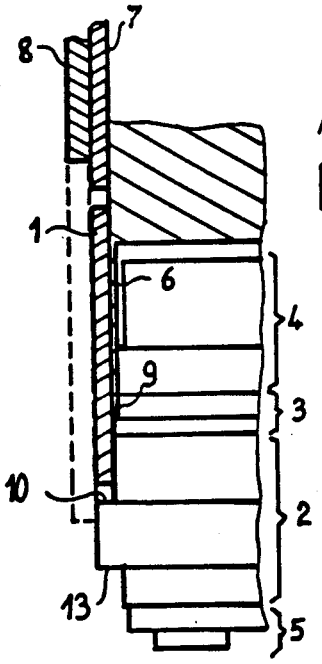
PRIOR ART
FIG_2
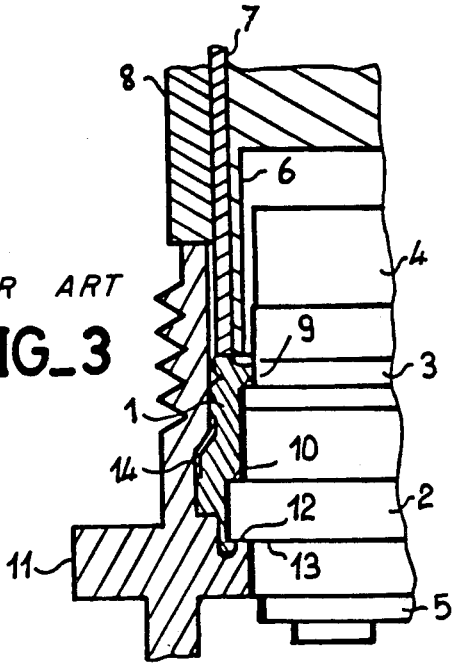
PRIOR ART
FIG_3

ELECTRICAL CONNECTOR WITH DEFORMABLE RETENTION ELEMENT AND PROCEDURE FOR ASSEMBLY OF SUCH A CONNECTOR

BACKGROUND OF THE INVENTION

1. Field of the Invention

The present invention relates to electrical connectors and their assembly procedure.

2. Description of the Prior Art

Cylindrical electrical connectors generally comprise a housing in which is lodged a stack of parts having aligned passages to receive contact plugs. The stack can comprise a retention element and be sealed in the housing by means of a resin before insertion of the contact plugs in their passages. The drawback of this assembly procedure is that the resin can penetrate into the passages provided for the plugs and partially block them, making it difficult or impossible to insert the plugs.

To solve this problem, French Pat. No. 2,341,211, which corresponds to U.S. Pat. No. 4,019,799, discloses an assembly procedure permitting the sealing of the connector with no risk of having the resin flow into the passages provided for insertion of the plugs.

According to this patent, such a connector comprising a housing in which is lodged a stack of parts having aligned passages provided to receive contact plugs, the stack including at least one washer forming a retention element for the plugs, and an insert separated from the housing by a space. The stack is held in the housing by a deformable laminated material that surrounds the insert and the washer, and fills the space comprised between them and the housing.

In practice, the laminated material is a porous tape which has to be wound around a sleeve. Two other sleeves are necessary to proceed with the assembly and prevent the tape from creasing. The device which permits the assembly therefore comprises three sleeves and the procedure, finally, is rather time consuming to implement.

It would be desirable to provide a connector and assembly technique which overcame these drawbacks.

SUMMARY OF THE INVENTION

In accordance with this invention, there is provided in an electrical connector comprising a housing and an insulating body for the receiving of at least one electrical contact, the insulating body abutting on an inside shoulder of the housing, the inside of the housing and the insulating body being of generally cylindrical shape, the attachment of the insulating body in the housing being assured by the deformation, in the space separating them, of a retention element, the improvement comprising that the inside of the housing and the insulating body both have beveled surfaces, the retention element, after deformation, filling up at least the space between the beveled surfaces to prevent the separation of the insulating body and the housing.

Also in accordance with this invention, there is provided a procedure for assembling an electrical connector, including installing the insulating body inside the housing, introducing the retention element in the space between the insulating body and the housing, and deforming the retention element by pressure with the aid of a plunger.

To remedy the drawbacks of the prior art, this invention proposes an electrical connector in which the retention element is sufficiently rigid so that the assembly will require only one sleeve. This result can be obtained by means of a special design of the parts to be assembled.

The retention element can be in the form of a tape or in the form of a ring.

In order to hold the parts to be assembled without play before the filling, it is advantageous to confer a profiled form on the retention element.

The retention element can be combined with a material such as resin which will increase the tightness of the connector. For example, if the retention element is provided with lateral slots, also making it possible to eliminate the play between the parts to be assembled, these slots can be filled with resin. This resin can be introduced in one form or another before the retention element is put in place.

The retention element is preferably made of metal. Aluminum is particularly well adapted as the retention element material.

BRIEF DESCRIPTION OF THE DRAWINGS

FIG. 1 represents a retention element according to the prior art.

FIGS. 2 and 3 illustrate an assembly procedure according to the prior art.

DESCRIPTION OF THE PREFERRED EMBODIMENTS

Figure 4:
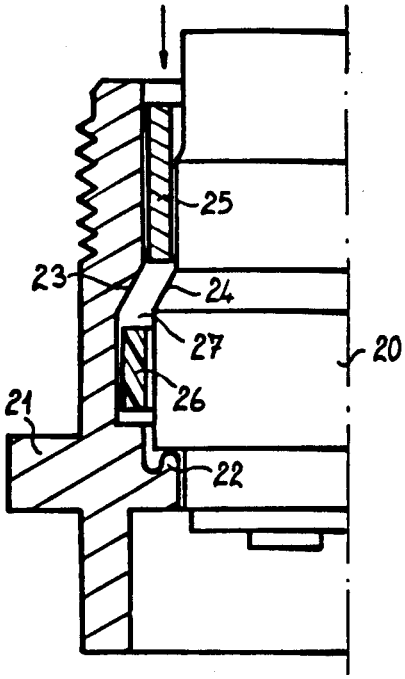
FIGS. 4 and 6 represent steps in the assembly procedure of the connector according to this invention.

FIG. 1 represents a retention element used by the assembly procedure according to the patent cited above. This element consists of a band 1 of laminated material. The laminate consists of a porous tape such as a lattice of phosphor bronze, a fiberglass cloth or mat, or other suitable materials. This tape can be toothed as represented in FIG. 1 and is impregnated with a thermosetting material such as a nonpolymerized epoxy resin.

FIGS. 2 and 3 relate to the assembly procedure of an electrical connector according to the prior art. The assembly is done as follows. First the tape 1 is wound around a stack constituting an insulating body and comprising an insert member 2, a retention wafer 3, a ring or grommet 4 and a seal 5. The insert 2 is bonded to wafer 3. The seal 5 and ring 4 can be glued to this assembly. The insulating body is provided, in the axis of seal 5, with aligned passages receiving the contact plugs. Before inserting these plugs, the laminate 1 is deformed by means of an appropriate tool. This tool comprises three coaxial sleeves: an inside sleeve 6, an intermediate sleeve 7 and an outside sleeve 8. The insulating body is first placed in inner sleeve 6, with the end of the sleeve abutting on a shoulder 9 of wafer 3. With outside sleeve 8 being retracted, as represented in solid lines in FIG. 2, the laminate 1 is wound around inside sleeve 6 so that one edge of the band will be in proximity to a shoulder 10 of the insert member 2. Outside sleeve 8 is then pushed down to cover tape 1 and assume the position represented in dotted lines in FIG. 2. A cylindrical housing or shell 11 is then threaded onto the insulating body by pushing outside sleeve 8 until an inside shoulder of the housing abuts against a shoulder 13 of insert 2. Outside sleeve 8 prevents tape 1 from twisting or folding as the housing is put in place.

Then intermediate sleeve 7 is pushed forward into the space between housing 11 and inside sleeve 6. Under the pressure exerted by intermediate sleeve 7, tape 1 deforms as it fills all the space possible as shown in FIG. 3. Since the space between housing 11 and insert 2 is practically filled by the deformed laminate, inside sleeve 6 is raised for a short distance as represented in FIG. 3, and then intermediate sleeve 7 is continued to be pushed to cause laminate 1 to flow over and around shoulder 9 on waver 3. In so doing, the laminate holds the stack in the housing from movement due to the filling of a groove 14 in housing 11. After polymerization of the resin by heat, the connector is ready to receive its contacts.

This assembly procedure, although useful, has several drawbacks. First, the tap is naturally deformable, which leads to taking certain precautions for winding and deforming it. The procedure involves three sleeves subjected to complicated relative movements. This requires a certain amount of time to implement the procedure which has repercussions on the cost price of the connector.

The invention remedies these drawbacks by the use of a more rigid retention element and a single sleeve, which is made possible by a special design of the various parts of the connector.

FIG. 4 represents an electrical connector according to the invention in the course of assembly of its various parts. There can be recognized the insulating body designated under the general reference 20 and a housing or shell 21. The housing has an inside shoulder 22 receiving the insulating body as in the connector described previously. A special feature of the housing and the insulating body is the presence of beveled surfaces, respectively 23 for the housing and 24 for the insulating body. These surfaces are represented in FIG. 4, as parallel to one another and situated at the same level. This is not obligatory and other arrangements are possible as will be seen below. A retention element 25 is provided and is made of a material that is sufficiently rigid so as not to require special precautions when it is put in place. In particular, when left to itself it does not wrinkle when it is placed in the space between the housing and the insulating body. The retention element can be metal, for example, aluminum or copper. It may be provided in the form of a band which is wound in order to be introduced into the space in question, or in the form of a collar or a slotted ring. The latter form facilitates its introduction.

Figure 5:
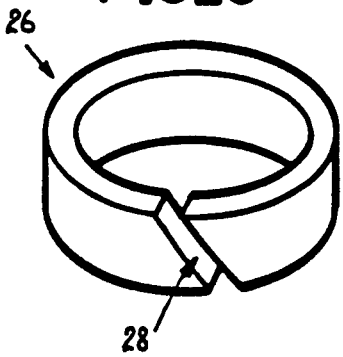
FIG. 5 represents a slotted washer used in the connector.

It is also possible, for purposes a tightness, to combine, with the retention element a preform 26 made of a material such as resin introduced either before the retention element as indicated in FIG. 4, or after the retention element. To facilitate its introduction in the case of a housing having an inside recess 27 with a diameter larger than the opening through which the insulating body is introduced, the preform may be in the form of a slotted washer 26 as shown in FIG. 5. The slot 28 is advantageously made on the bias so that when it is squeezed, there will actually be a resin seal along the entire perimeter involved.

Retention element 25 introduced between insulating body 20 and housing 21 remains fixed at approximately the point where it is represented in FIG. 4 due to beveled surface 24. With the aid of a plunger, in the form of a hollow cylinder applying a pressure in the direction indicated by the arrow, element 25 will be put in place.

Figure 6:
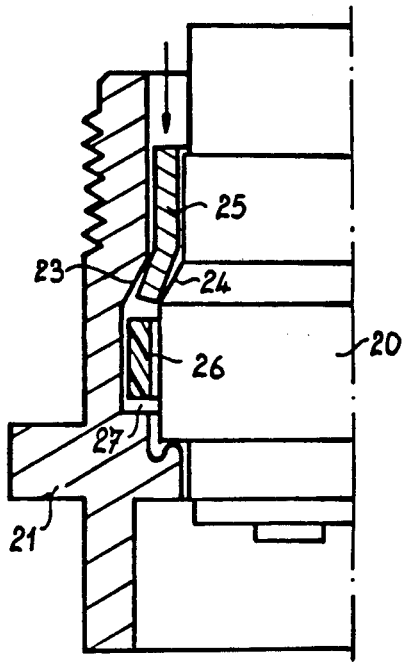

FIG. 6 shows the deformation assumed by element 25 as it is put in place when it reaches the level of beveled surfaces 23 and 24.

Figure 7:
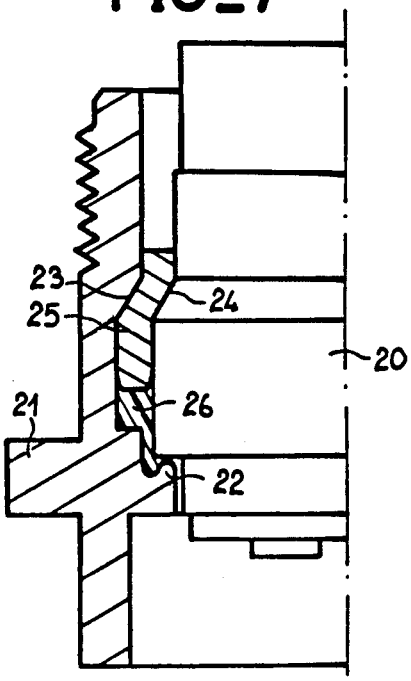
FIG. 7 represents the connector according to the invention after assembly.

FIG. 7 shows retention element 25 in place, the plunger having been withdrawn. By means of element 25, preform 26 has also been deformed and this insures the tightness of the connector. The retention of the insulating body is effectively assured by the surfaces 23 and 24 which prevent any displacement of element 25 and hence of insulating body 20. Surface 24 also permits holding body 20 firmly on the shoulder during the pressing.

Other arrangements of the beveled surfaces are, of course, possible without departing from the scope of the invention. These surfaces may or may not be parallel to one another. They can even be inclined in opposite directions. The important thing is that they counteract forces tending to separate the insulating body from the housing.

Figure 8:
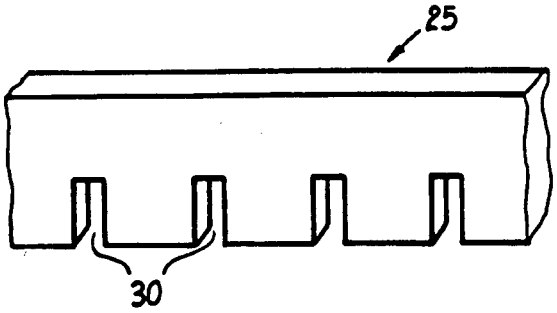
FIG. 8 represents a retention element before installation.
Figure 9:
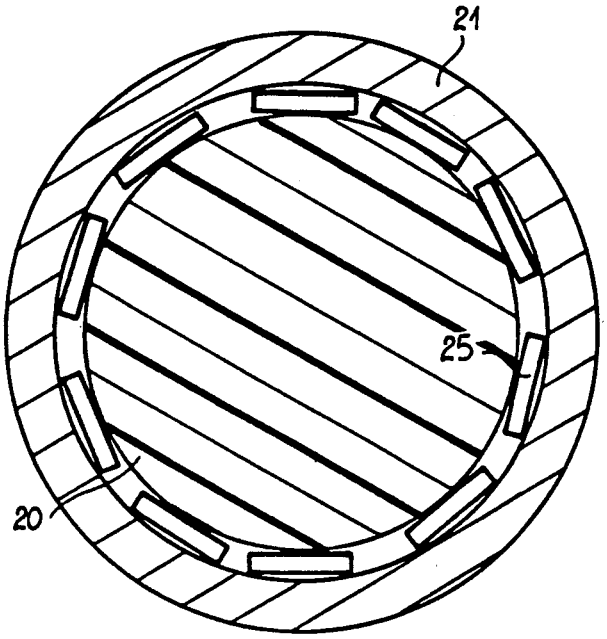
FIG. 9 is a view in cross-section of the connector during assembly.

FIG. 8 represents an example of a retention element 25 before it is installed. This element is in the form of a metal band, for example, of aluminum. In this band, slots 30 have been made perpendicularly to one of its edges. These slots facilitate the deformation of the retention element under the influence of pressure. It is advantageous to dispose the slots with a predetermined pitch, adapted to the diameters of the parts to be assembled, primarily the inner diameter of the housing and the outer diameter of the insulating body. This will permit eliminating the play between the parts to be joined together and will contribute to the centering of insulating body 20 in housing 21 as shown in FIG. 9. It is also possible to provide the slots with resin for the purpose mentioned above.

The resin preform of FIGS. 5 to 7 can be integrated with the retention element, such as in the case of FIG. 8, or by coating or gluing. This will mean a minimum of pieces to be assembled with a limited number of tools.

The retention element can have a profiled section to assure its function as a locking wedge for the insulating body and to eliminate the play existing between the parts to be joined together.

The installation of the retention element (band or ring) can be done on a press with the aid of a tubular plunger with a preset stroke. The invention lends itself particularly well to automation of the assembly procedure. The retention element can also be made of plastic or any other deformable material with equivalent mechanical characteristics.

We claim:

1. Electrical connector comprising a housing having an inside shoulder, an insulating body for receiving at least one electrical contact, the insulating body being disposed within said housing and abutting said inside shoulder of the housing, the inside of the housing and the insulating body being of generally cylindrical shape and having beveled surfaces defining a space therebetween, and a retention element disposed within said space, said retention element being deformable under pressure so as to fill up at least the space between the said beveled surfaces to prevent the separation of said insulating body and said housing.

2. Electrical connector according to claim 1, wherein said retention element, before it is installed, is in the form of a band.

3. Electrical connector according to claim 1, wherein said retention element, before it is installed, is in the form of a ring.

4. Electrical connector according to claim 1, wherein said retention element is made of metal.

5. Electrical connector according to claim 1, wherein said retention element has a profiled section assuring its function as blocking wedge for said insulating body.

6. Electrical connector according to claim 5, wherein said retention element is provided with lateral slots.

7. Electrical connector according to claim 6, wherein said slots are provided according to a predetermined pitch selected as a function of the outer diameter of said insulating body and the inner diameter of said housing, such that in the non-deformed condition the retention element eliminates the play between said insulating body and said housing.

8. Electrical connector according to claim 6, wherein said slots formed in said retention element are filled with resin.

9. Electrical connector according to claim 1, wherein a preform of resin is also placed in the space separating said housing from said insulating body so as to be pressed by means of said retention element during the deformation.

10. Electrical connector according to claim 9, wherein said preform is in the form of a slotted washer.

11. A method of assembling an electrical connector including a housing having an inside shoulder and an insulating body for receiving at least one electrical contact comprising the steps of installing said insulating body inside said housing such that it abuts said inside shoulder of said housing, introducing a retention element into the space between the insulating body and the housing and deforming the retention element by pressure with the aid of a plunger.

12. The method of claim 11, further comprising introducing a preform of resin so that it surrounds the insulating body prior to installing said insulating body inside said housing.

13. The method of claim 12, wherein said retention element has a profiled section.

14. The method of claim 13, wherein said retention element has lateral slots.

15. The method of claim 14, wherein said preform is in the form of a slotted washer.

* * * * *